US011075028B2

(12) United States Patent
Park et al.

(10) Patent No.: US 11,075,028 B2
(45) Date of Patent: Jul. 27, 2021

(54) IMPACT ACTUATOR WITH 2-DEGREE OF FREEDOM AND IMPACT CONTROLLING METHOD

(71) Applicant: KOREA INSTITUTE OF SCIENCE AND TECHNOLOGY, Seoul (KR)

(72) Inventors: Jaeyoung Park, Seoul (KR); Sangyoon Kim, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 378 days.

(21) Appl. No.: 16/238,971

(22) Filed: Jan. 3, 2019

(65) Prior Publication Data

US 2020/0058427 A1 Feb. 20, 2020

(30) Foreign Application Priority Data

Aug. 14, 2018 (KR) ..... 10-2018-0095038

(51) Int. Cl.
*H01F 7/00* (2006.01)
*H01F 7/16* (2006.01)
(Continued)

(52) U.S. Cl.
CPC ..... *H01F 7/16* (2013.01); *H01F 7/081* (2013.01); *H01F 7/10* (2013.01); *G08B 6/00* (2013.01)

(58) Field of Classification Search
CPC ... H01F 7/16; H01F 7/10; H01F 7/081; H01F 7/122; G08B 6/00; H02N 11/006;
(Continued)

(56) References Cited

U.S. PATENT DOCUMENTS 3,070,730 A * 12/1962 Gray ..... H01F 7/1615 335/229
3,203,447 A * 8/1965 Bremner ..... F16K 31/082 137/595
(Continued)

FOREIGN PATENT DOCUMENTS

JP 2013-154290 A 8/2013
KR 10-0739086 B1 7/2007
(Continued)

OTHER PUBLICATIONS

Sang-Youn Kim et al., "Miniature Impact Actuator for Haptic Interaction with Mobile Devices", International Journal of Control, Automation, and Systems, 2014, pp. 1283-1288, vol. 12, No. 6.
(Continued)

*Primary Examiner* — Shawki S Ismail
*Assistant Examiner* — Lisa N Homza
(74) *Attorney, Agent, or Firm* — Rabin & Berdo, P.C.

(57) ABSTRACT

An impact actuator with 2-degree of freedom, which may generate an impact stimulation in any direction on the plane, includes a body having a magnetic substance that is movable therein, one upper solenoid attached to an upper portion of the body, and three or more lower solenoids attached to a lower portion of the body, wherein the upper solenoid and the three or more lower solenoids are independently supplied with AC power from a power supply, respectively.

6 Claims, 10 Drawing Sheets

(51) Int. Cl.
*H01F 7/10* (2006.01)
*H01F 7/08* (2006.01)
*G08B 6/00* (2006.01)

(58) Field of Classification Search
CPC ..... G06F 3/041; H02K 33/00; H02K 33/12; H02K 33/14
USPC ..... 335/229
See application file for complete search history.

(56) References Cited

U.S. PATENT DOCUMENTS 3,497,845 A * 2/1970 Bernier ..... H01H 50/36 335/234
4,001,742 A * 1/1977 Jencks ..... H01H 71/56 335/173
4,490,815 A * 12/1984 Umehara ..... H01F 7/1615 335/234
4,533,890 A * 8/1985 Patel ..... F01L 9/20 335/234
4,829,947 A * 5/1989 Lequesne ..... H01F 7/1615 123/90.11
4,847,726 A * 7/1989 Mody ..... H01F 7/1646 361/147
5,663,541 A * 9/1997 Mc Gregor, II ..... B66D 1/46 200/17 R
5,742,106 A * 4/1998 Muraji ..... F02M 3/07 310/190
5,896,076 A * 4/1999 van Namen ..... H01F 7/1615 335/229
6,518,685 B2 * 2/2003 Nelson ..... H02K 7/12 310/103
6,836,201 B1 * 12/2004 Devenyi ..... H01F 7/1816 335/229
7,616,084 B2 * 11/2009 Lu ..... B23B 1/00 269/8
7,633,361 B2 * 12/2009 Raklyar ..... H01P 1/125 200/16 R
7,772,947 B2 * 8/2010 Trumper ..... H02K 33/16 335/228
8,035,260 B2 * 10/2011 Fullerton ..... G09F 7/04 310/49.01
8,646,280 B2 * 2/2014 Chang ..... H02N 11/002 62/3.1
8,665,041 B2 * 3/2014 Christenson ..... H01H 50/005 335/78
9,489,810 B2 11/2016 Tissot
2002/0008601 A1 * 1/2002 Yajima ..... H01F 7/1615 335/220
2004/0025949 A1 * 2/2004 Wygnaski ..... F16K 31/082 137/624.18
2006/0109256 A1 * 5/2006 Grant ..... G06F 3/0485 345/173
2008/0079520 A1 * 4/2008 Vranish ..... H01F 7/08 335/207
2008/0110732 A1 * 5/2008 Adunka ..... H01H 3/001 200/43.01
2010/0001592 A1 * 1/2010 Kawano ..... A61B 1/00158 310/12.14
2013/0193779 A1 8/2013 Kuroda
2015/0248959 A1 * 9/2015 Hamelinck ..... H02N 15/00 335/229
2016/0233012 A1 * 8/2016 Lubinski ..... H01F 41/02
2018/0226868 A1 * 8/2018 Gieras ..... H02K 1/34
2019/0139689 A1 * 5/2019 Ogawa ..... H01F 7/122
2020/0020472 A1 * 1/2020 Edrington ..... H01F 7/081
2020/0328018 A1 * 10/2020 Tesen ..... H01F 7/121

FOREIGN PATENT DOCUMENTS

KR 10-2012-0071518 A 7/2012
KR 10-1774250 B1 9/2017
WO WO 2018/051920 A1 3/2018

OTHER PUBLICATIONS

Tae-Heon Yang et al., "Development and Evaluation of an Impact Vibration Actuator Using an Unstable Mass for Mobile Devices", International Journal of Control, Automation, and Systems, 2016, pp. 827-834, vol. 14, No. 3.

* cited by examiner

IMPACT ACTUATOR WITH 2-DEGREE OF FREEDOM AND IMPACT CONTROLLING METHOD

CROSS-REFERENCE TO RELATED APPLICATION

This application claims priority to Korean Patent Application No. 10-2018-0095038, filed on Aug. 14, 2018, and all the benefits accruing therefrom under 35 U.S.C. § 119, the contents of which in its entirety are herein incorporated by reference.

BACKGROUND

1. Field

The present disclosure relates to an impact actuator with 2-degree of freedom and an impact controlling method, and more particularly, to an impact actuator with 2-degree of freedom, which may generate an impact stimulation in any direction on the plane, and a method for controlling the generation of impact stimulation by using the impact actuator.

2. Description of the Related Art

Various electronic devices recently used in daily life have been increasingly equipped with a unit for transmitting haptic stimulation to interact with a user by providing haptic feedback, and the study is being actively conducted on this.

In particular, in order to actually transmit the haptic feedback according to the interaction with a virtual object in a virtual reality space, the tactile simulation transmitting device may include one or more impact actuators.

A conventional actuator used in a portable device has a solenoid and a magnetic substance, and control the movement of the magnetic substance to generate an impact stimulation. The solenoid is a structure in which a conductive wire is wound on a cylindrical iron core to form a strong magnetic field by supplying a current thereto. At this time, the magnetic substance around the solenoid may be moved by the generated magnetic field, and the impact stimulation by the magnetic substance is controlled by adjusting the direction or the like of the current applied to the solenoid by using the movement of the magnetic substance.

However, the conventional actuator is a linear actuator and has a limitation in that the impact stimulation may be provided only in one direction. In addition, immediately after the magnetic substance collides in a specific direction to generate a stimulation, it is impossible to regenerate an impact in the same direction, or it is difficult to generate an accurate impact stimulation due to the presence of residual vibration caused by an elastic body.

RELATED LITERATURES

Non-Patent Literature (Non-patent Literature 1) S. Y. Kim, T. H. Yang, "Miniature Impact Actuator for Haptic Interaction with Mobile Devices", International Journal of Control, Automation and Systems, Vol. 12, No. 6, pp 1283-1288, 2014

SUMMARY

The present disclosure is designed to solve the above problem, and the present disclosure is directed to providing an impact actuator with 2-degree of freedom, which may generate an impact stimulation in any direction on the plane, and an impact controlling method using the impact actuator with 2-degree of freedom to generate a suitable impact stimulation.

The objects of the present disclosure are not limited to the above, and other objects not mentioned herein will be clearly understood by those skilled in the art from the following disclosure.

In one aspect of the present disclosure, there is provided an impact actuator with 2-degree of freedom, comprising: a body having a magnetic substance that is movable therein; one upper solenoid attached to an upper portion of the body; and three or more lower solenoids attached to a lower portion of the body, wherein the upper solenoid and the three or more lower solenoids are independently supplied with Alternating Current (AC) power from a power supply, respectively.

According to an embodiment of the present disclosure, the three or more lower solenoids may be composed of the same four solenoids having a quartered cylindrical shape.

According to an embodiment of the present disclosure, the magnetic substance may be fixed to a neutral position that is a center portion of the body, when a current is not supplied to the upper solenoid and the three or more lower solenoids.

According to an embodiment of the present disclosure, the magnetic substance may be fixed by an attractive force with an iron member included at the neutral position of the body, the upper solenoid or the three or more lower solenoids.

According to an embodiment of the present disclosure, the magnetic substance may collide with the body by an impact of a direction and strength, which are determined by whether or not to supply a current to the upper solenoid and the three or more lower solenoids, respectively, and by at least one of a direction of the current and intensity of the current.

According to an embodiment of the present disclosure, the magnetic substance may return to a neutral position after colliding with the body.

In another aspect of the present disclosure, there is also provided an impact controlling method using an impact actuator, comprising: determining a direction, strength and form of an impact stimulation; determining whether or not to supply a current to the upper solenoid and the three or more lower solenoids, respectively, and a direction of the current and intensity of the current, based on the direction, strength and form of the impact stimulation; and applying a current to the upper solenoid and the three or more lower solenoids, respectively, according to the determination whether or not to supply a current and according to the direction of the current and intensity of the current to move the magnetic substance so that an impact stimulation is generated.

According to an embodiment of the present disclosure, the impact controlling method may further comprise allowing the magnetic substance to return to a neutral position after the impact stimulation is generated.

The impact actuator with 2-degree of freedom according to various embodiments of the present disclosure may generate an impact stimulation in any direction on the plane, so that the impact stimulation may be dynamically implemented. In addition, since the mass (the magnetic substance) has a neutral position, it is possible to have a wide frequency band and to regenerate an impact in the same direction. The mass may be designed to return to the neutral position after collision, and the residual vibration problem may be prevented since an elastic body is not needed. The magnitude, direction and form of the impact stimulation may be controlled in various ways by adjusting the direction and intensity of the current used for driving the impact actuator with 2-degree of freedom. The present disclosure may be utilized for virtual reality (VR)/augmented reality (AR), 4D entertainment systems, games, small/pocket-type interfaces, wearable equipment, related researches, and the like.

The effects obtainable from the present disclosure are not limited to the effects mentioned above, and other effects not mentioned herein will be clearly understood by those skilled in the art from the following disclosure.

DETAILED DESCRIPTION

Figure 1:
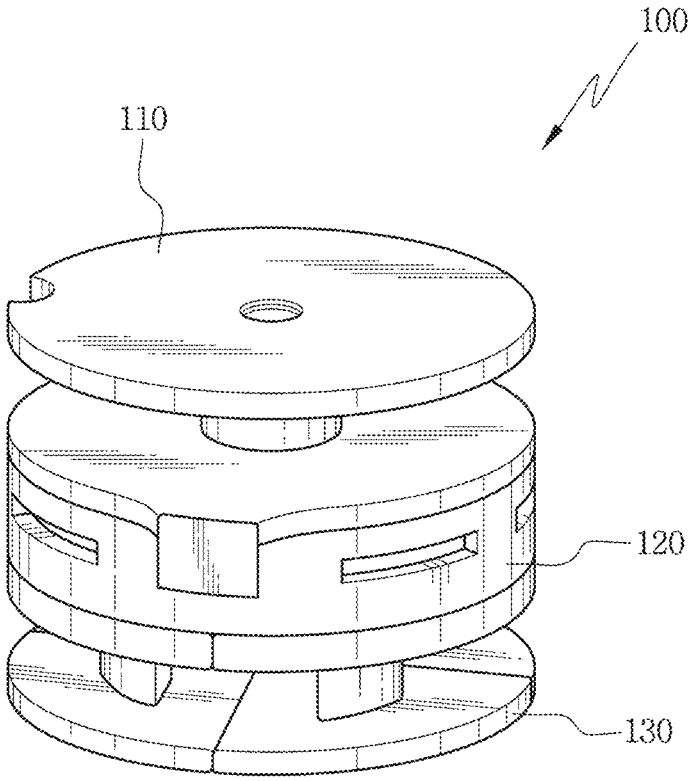
FIG. 1 is a schematic view showing an impact actuator with 2-degree of freedom according to an embodiment of the present disclosure.

Hereinafter, an impact actuator with 2-degree of freedom and an impact controlling method according to an embodiment of the present disclosure will be described with reference to the accompanying drawings. Even though the present disclosure is with reference to the embodiment shown in the drawings, this is just an embodiment, and the technical features of the present disclosure and its essential configuration and operation are not limited thereto.

Figure 2:
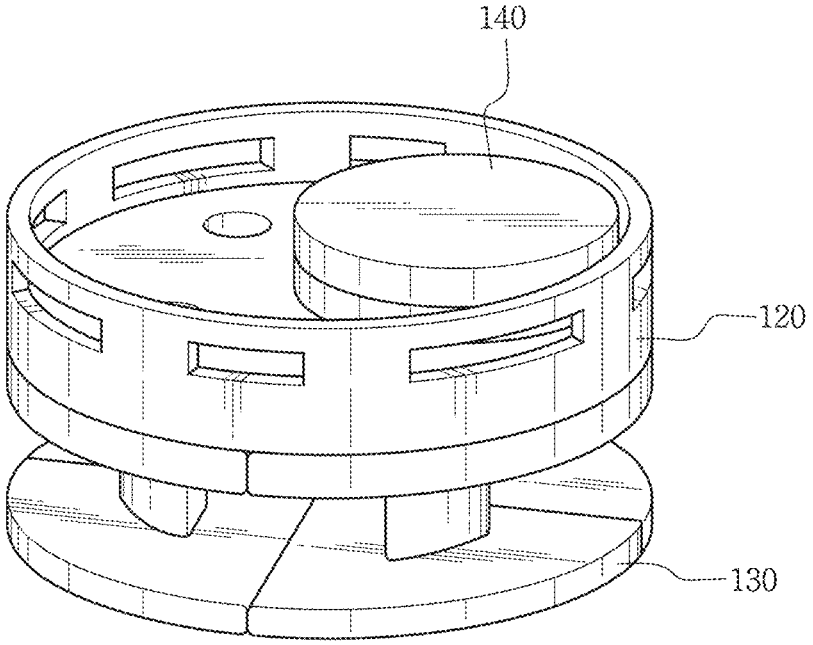
FIG. 2 is an exploded view showing the impact actuator with 2-degree of freedom according to an embodiment of the present disclosure.

FIG. 1 is a schematic view showing an impact actuator 100 with 2-degree of freedom according to an embodiment of the present disclosure. FIG. 2 is an exploded view showing the impact actuator 100 with 2-degree of freedom according to an embodiment of the present disclosure.

Referring to FIGS. 1 and 2, the impact actuator 100 with 2-degree of freedom according to an embodiment of the present disclosure includes an upper solenoid 110, a body 120 and a plurality of lower solenoids 130.

The upper solenoid 110 and the lower solenoids 130 generate a magnetic field to control the movement of a magnetic substance 140 located inside the body 120. The magnetic substance 140 may be, for example, a permanent magnet.

Figure 4:
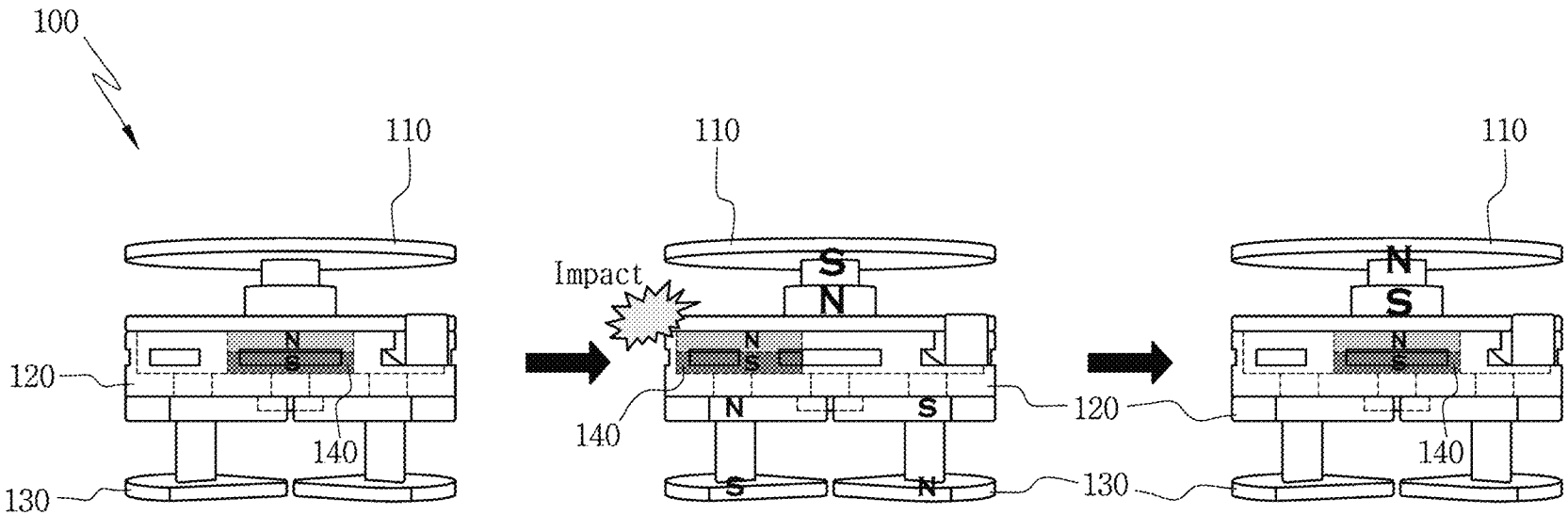
FIG. 4 is a diagram for illustrating the operation of the impact actuator with 2-degree of freedom according to an embodiment of the present disclosure.

The upper solenoid 110 is attached to an upper surface of the body 120 having a cylindrical form. As shown in FIG. 4, the upper solenoid forms a magnetic field at a solenoid core portion.

For example, if it is intended to form a strong magnetic field at the solenoid 110, an iron core made of a soft iron rod may be inserted into the solenoid 110. Here, the iron core may become a strong magnet due to a weak magnetic field, and, if a current is applied to the solenoid 110, the iron core is magnetized due to the magnetic field caused by the current. At this time, since the iron core is magnetized in the same direction as the magnetic field generated by the solenoid 110, the magnetic field of the iron core and the magnetic field of the solenoid 110 may be united to form a strong magnetic field. The solenoid 110 may be configured so that the iron core is included at the solenoid core portion and is surrounded by a solenoid coil.

In addition, as shown in FIG. 1, the solenoid 110 may include a solenoid core portion, and an upper plate and a lower plate connected to both ends of the solenoid core portion. According to an embodiment of the present disclosure, the solenoid core portion may be connected to the center portions of the upper and lower plates having a circular shape. At this time, the iron core may be provided at the solenoid core portion, and the magnetic substance 140 is fixed to a neutral position in the body 120 by the iron core, and only when a current is applied to the solenoids 110, 130, the magnetic substance 140 may move by a stronger magnetic force and then be induced to return to the neutral position again.

According to another embodiment of the present disclosure, the iron element for inducing the magnetic substance 140 to the neutral position may be attached to the center portion of the upper or lower plate of the body.

As shown in FIGS. 1 and 2, the body 120 includes the magnetic substance 140 therein, and the magnetic substance 140 may have a cylindrical shape with a circular cross-section so as to apply an impact stimulation in any direction on the plane. In particular, the body 120 may have a cylindrical shape with a height similar to or slightly higher than the thickness of the magnetic substance 140, so that the magnetic substance 140 does not move in a height direction. However, the body 120 is not necessarily limited to the cylindrical shape and may have various polygonal pillar shapes as necessary.

According to an embodiment of the present disclosure, the body 120 may basically include a side surface of the cylinder, and the upper surface or the lower surface may be replaced with the lower plate of the upper solenoid 110 and the upper plate of the lower solenoid 130, respectively. In other words, at least one of the upper surface and the lower surface of the body 120 may be omitted and assembled with the upper solenoid 110 and the lower solenoid 130 to configure the impact actuator with 2-degree of freedom as shown in FIG. 1.

The upper solenoid 110 is fixedly attached to the upper surface of the body 120, and the lower solenoid 130 is fixedly attached to the lower surface of the body 120. The solenoids 110, 130 may be fixed to the upper and lower surfaces of the body 120, respectively, by a fixing member. For example, the lower plate of the upper solenoid 110 and the upper plate of the lower solenoid 130 may be fixed to the body 120 using a hook, a screw or the like as the fixing member. Alternatively, the lower plate of the upper solenoid 110 and the upper plate of the lower solenoid 130 may have a concave shape, and the upper surface and the lower surface of the body 120 may have a convex shape, so that they are fixed to each other by fitting.

The plurality of lower solenoids 130 are disposed below the body 120 having the magnetic substance 140 to control the magnitude and direction of the magnetic field of each of the plurality of lower solenoids 130 by adjusting the intensity and direction of the current applied to each of the plurality of lower solenoids 130, and serves as an element for controlling the movement of the magnetic substance 140 by interacting with the magnetic field formed by the upper solenoid 110.

The plurality of lower solenoids 130 may include at least three solenoids for operating the impact actuator 100 with 2-degree of freedom. If the plurality of lower solenoids 130 have one solenoid, it is impossible to induce the magnetic substance 140 to move on the plane. If the plurality of lower solenoids 130 include two solenoids, the magnetic substance 140 is able to make only linear movement. Therefore, the plurality of lower solenoids 130 should include at least three solenoids.

Both the upper solenoid 110 and the lower solenoid 130 may be connected to a power supply (not shown) to control the intensity and direction of the current. The power supply may be an external power supply that supplies an Alternating Current (AC) power to the solenoid coil, and the upper solenoid 110 and the lower solenoid 130 may be independently connected to the power supply and receive the current. At this time, the intensity and direction of the current supplied to the upper solenoid 110 and the lower solenoid 130, respectively, may be independently controlled. Since the plurality of lower solenoids 130 are respectively connected to the power supply and the direction of collision is controlled by adjusting each current, the complexity for collision control increases as the number of solenoids increases.

As the number of the plurality of lower solenoids 130 increases, the precision of movement control of the magnetic substance 140 may be enhanced, but the control complexity also increases. Thus, four lower solenoids 130 may be provided, desirably.

Figure 3A:
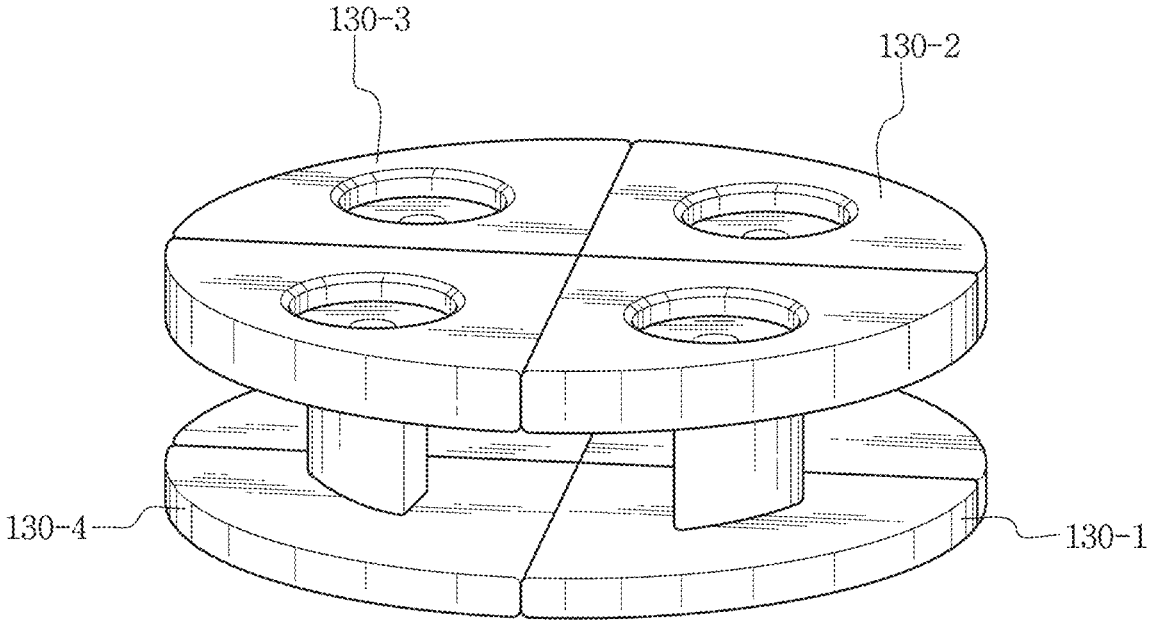
FIGS. 3A and 3B show a structure of a lower solenoid according to an embodiment of the present disclosure.
Figure 3B:
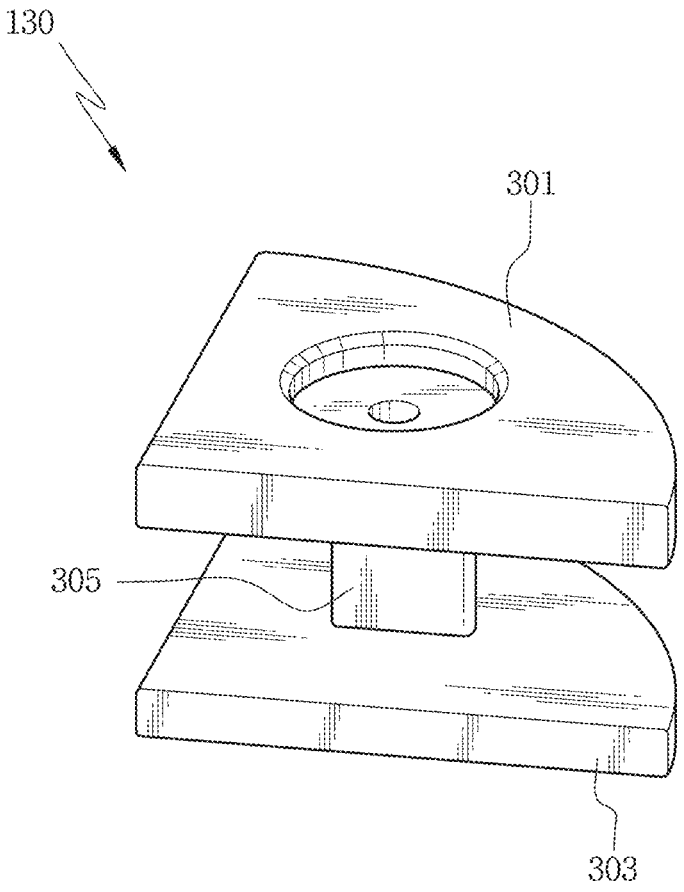

FIGS. 3A and 3B show a structure of the lower solenoid 130 according to an embodiment of the present disclosure.

Referring to FIG. 3A, the lower solenoids 130 according to an embodiment of the present disclosure include four solenoids 130-1, 130-2, 130-3, 130-4. As shown in FIG. 3A, for example, the four solenoids 130-1, 130-2, 130-3, 130-4 may assembled to form one cylindrical shape, and the four solenoids 130-1, 130-2, 130-3, 130-4 may have the same shape.

Referring to FIG. 3B, the structure of one lower solenoid 130 is depicted, in a case where the lower solenoids are composed of four solenoids. Since four solenoids are assembled to form a cylindrical shape with a circular cross-section, one lower solenoid 130 may have a cross section with a ¼ circular shape. As shown in FIG. 3B, for example, the lower solenoid 130 may include an upper plate 301, a lower plate 303, and a solenoid core portion 305 connecting the upper plate 301 and the lower plate 303. The solenoid core portion 305 may be formed to connect and support the center portions of the upper plate 301 and the lower plate 303, include an iron core therein, and be surrounded by a solenoid coil.

According to an embodiment of the present disclosure, the iron core of the upper solenoid 110 is exposed at a region of the solenoid core portion connected to the body 120, so that the magnetic substance 140 may be fixed to the center portion (namely, at a neutral position) of the upper solenoid 110 by means of the magnetic attractive force. At this time, the iron core of the lower solenoid 130 may located only inside the solenoid core portion without being exposed to the outside, so that the magnitude of the magnetic force applied to the magnetic substance 140 is insignificant. In this configuration, the magnetic substance 140 may be fixed at the neutral position and be easily recovered to the neutral position after a collision. According to another embodiment of the present disclosure, a member made of iron may be separately disposed at the neutral position so that the magnetic substance 140 is fixed to the neutral position by the magnetic attractive force.

Hereinafter, the operation of the impact actuator 100 with 2-degree of freedom and the impact controlling method will be described with reference to FIGS. 4 to 6. For convenience of explanation, the size of the N and S characters in the drawing is depicted to be increased in proportion to the magnitude of the magnetic force.

FIG. 4 is a diagram for illustrating the operation of the impact actuator 100 with 2-degree of freedom according to an embodiment of the present disclosure.

Referring to the first stage of FIG. 4, the impact actuator 100 with 2-degree of freedom includes the magnetic substance 140 provided inside the body 120, one upper solenoid 110 covering the upper portion of the body 120, and a plurality of (for example, four) lower solenoids 130 covering the lower portion of the body 120. The magnetic substance 140 may be fixed at the neutral position as shown in the first stage of FIG. 4 due to an iron member (for example, the iron core of the upper solenoid 110 or a separate member made of iron) disposed at the neutral position (center portion) of the body 120, the upper solenoid 110 or the lower solenoid 130. As shown in the first stage of FIG. 4, for example, the magnetic substance 140 may be a permanent magnet whose upper portion is an N pole and lower portion is an S pole.

Referring to the second stage of FIG. 4, according to an embodiment of the present disclosure, a current may be applied to the upper solenoid 110 so that the lower portion becomes an N pole and the upper portion becomes an S pole, and a current may be applied to two lower solenoids 130 in an opposite direction so that the upper/lower portions thereof becomes N pole/S pole and S pole/N pole, respectively. In this case, the upper portion of the magnetic substance 140 having the N pole gives a strong repulsive force the N pole of the upper solenoid 110, and the lower portion of the magnetic substance 140 having the S pole gives an attractive force to the N pole of the lower solenoid 130, so that the magnetic substance 140 collides with a left wall as shown in the second stage of FIG. 4. In this way, an impact stimulation is applied to the left wall.

Referring to the third stage of FIG. 4, according to an embodiment of the present disclosure, a current is applied to the upper solenoid 110 in a direction opposite to the second stage of FIG. 4, so that the lower portion of the upper solenoid 110 has an S pole and the upper portion has an N pole, and a current may not be applied to the lower solenoid 130. In this case, a strong attraction is applied only between the upper portion of the magnetic substance 140 having the N pole and the S pole of the upper solenoid 110, and thus the magnetic substance 140 returns to the neutral position as shown in the third stage of FIG. 4.

As described above, the direction, speed, frequency and strength of the impact may be controlled by adjusting whether or not to supply a current to the upper solenoid 110 and the lower solenoid 130 of the impact actuator 100 with 2-degree of freedom, and by adjusting the current intensity and the current direction. The frequency of the impact may mean the number of repeated collisions for a certain period of time in the case of vibration stimulation.

FIGS. 5A to 5D are diagrams for illustrating various examples of controlling the impact actuator 100 with 2-degree of freedom according to an embodiment of the present disclosure. For example, a method of controlling collision by adjusting a moving direction of the magnetic substance 140 will be described with reference to the internal configuration of the body in which the upper solenoid 110 is omitted in a state of the first stage of FIG. 4. Though not shown in FIGS. 5A to 5D, a current may be applied to the upper solenoid 110 to have an N pole at the lower portion and have an S pole at the upper portion, so that the magnetic substance 140 moves more easily by the repulsive force, as shown in the second stage of FIG. 4.

Figure 5A:
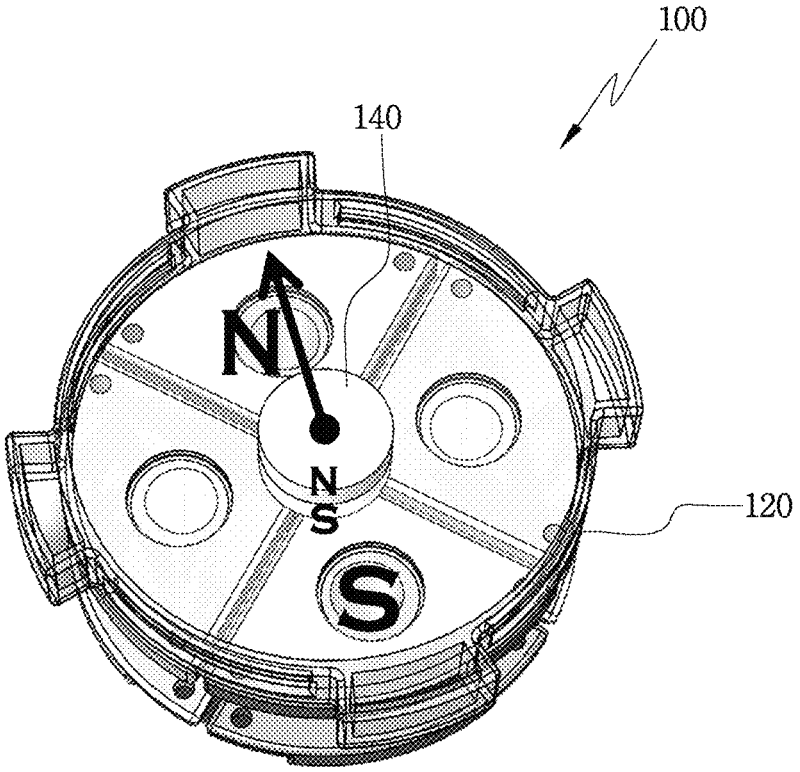
FIGS. 5A to 5D are diagrams for illustrating various examples of controlling the impact actuator with 2-degree of freedom according to an embodiment of the present disclosure.

Referring to FIG. 5A, in a state where the magnetic substance 140 is at the neutral position (the center portion), currents may be supplied to a pair of facing lower solenoids 130 among the four lower solenoids 130 in opposite directions, so that an N Pole and an S pole are be formed at the upper surfaces of the lower solenoids 130 on which the magnetic substance 140 is located. As shown in FIG. 5A, the magnetic substance 140 disposed to have an S pole at the lower portion thereof may transmit an impact stimulation toward the N pole (along the arrow). At this time, as the intensity of the magnetic force formed at the lower solenoid 130 becomes stronger, the magnetic attractive force acting on the magnetic substance 140 becomes larger and the collision speed of the magnetic substance 140 becomes faster. If the collision speed of the magnetic substance 140 increases, a larger impact stimulation may be generated.

Figure 5B:
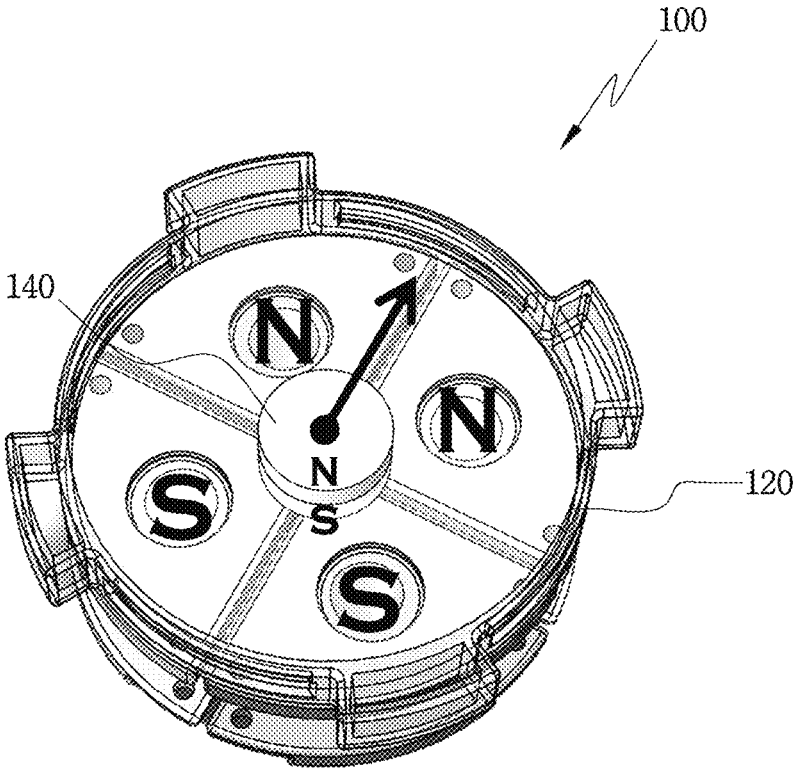

Referring to FIG. 5B, in a state where the magnetic substance 140 is at the neutral position (the center portion), currents may be supplied to a pair of neighboring lower solenoids 130 among the four lower solenoids 130 in the same direction, and currents may be supplied to the other pair of neighboring lower solenoids 130 in opposite directions. In this case, as shown in FIG. 5B, the upper surfaces of the pair of neighboring lower solenoids 130 have an N pole, and the upper surfaces of the other pair of neighboring lower solenoids 130 have an S pole. The magnetic substance 140 disposed to have an S pole at the lower portion thereof may transmit an impact stimulation toward the center of the N poles (along the arrow) of the pair of lower solenoids 130.

Figure 5C:
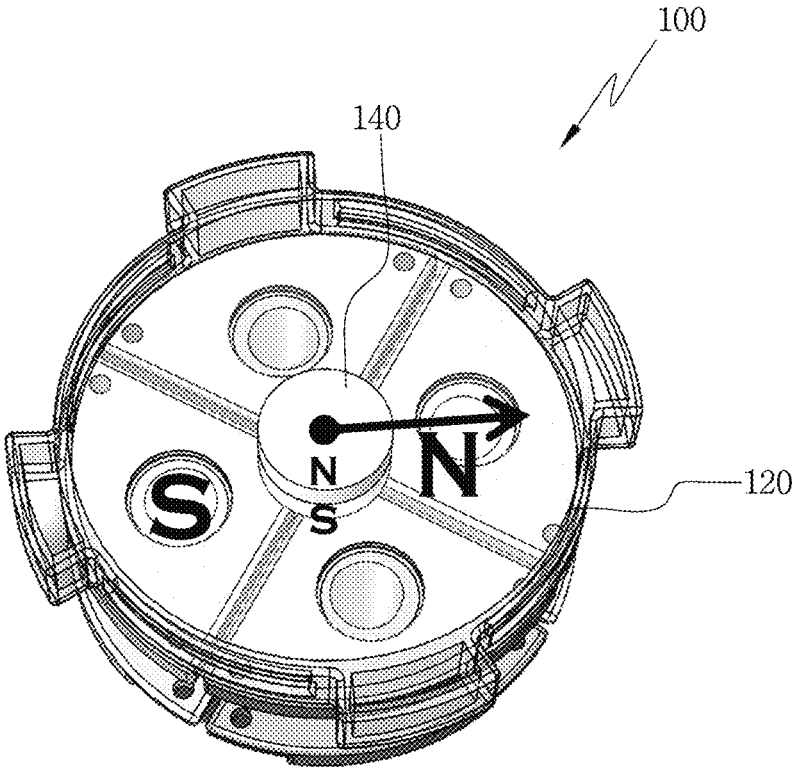

Referring to FIG. 5C, in a state where the magnetic substance 140 is at the neutral position (the center portion), currents may be supplied to the other pair of facing lower solenoids 130 among the four lower solenoids 130 in opposite directions, so that an N Pole and an S pole are be formed to face each other at the upper surfaces of the lower solenoids 130 on which the magnetic substance 140 is located. As shown in FIG. 5C, the magnetic substance 140 disposed to have an S pole at the lower portion thereof may transmit an impact stimulation toward the N pole (along the arrow).

Figure 5D:
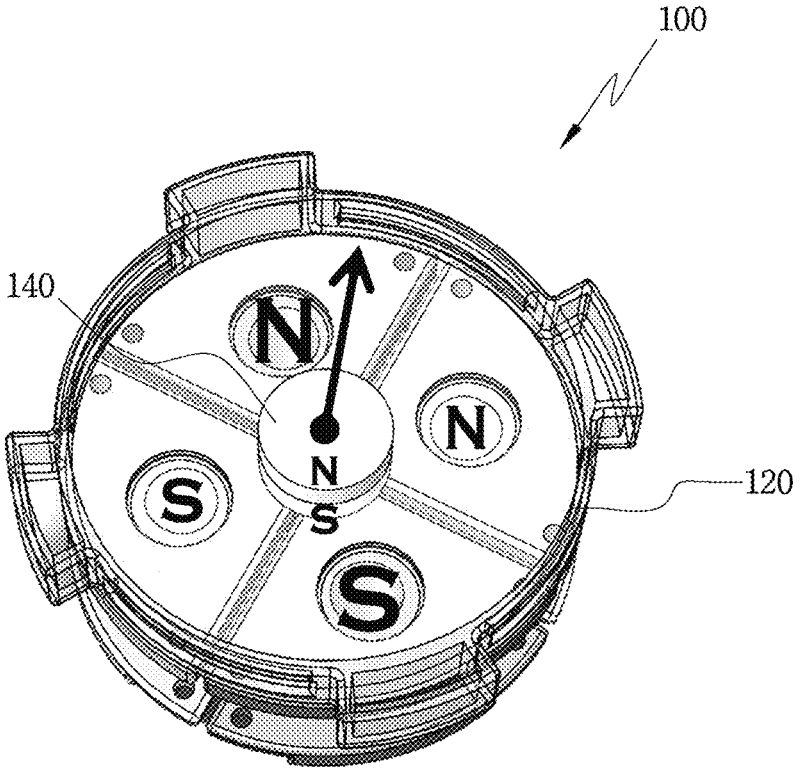

Referring to FIG. 5D, in a state where the magnetic substance 140 is at the neutral position (the center portion), currents may be supplied to a pair of neighboring lower solenoids 130 among the four lower solenoids 130 in the same direction, and currents may be supplied to the other pair of neighboring lower solenoids 130 in opposite directions. Different from FIG. 5B, the moving direction of the magnetic substance 140 may be precisely controlled by changing the intensity of the current supplied to each of the pair of neighboring lower solenoids 130. For example, as shown in FIG. 5D, the upper surfaces of the pair of neighboring lower solenoids 130 have an N pole, but the intensity of the current may be adjusted to further increase the magnetic force of the left N pole. According to an embodiment of the present disclosure, the plurality of lower solenoids 130 may be configured to have the same shape, winding position, number of windings, and the like. In this case, since the intensity of the magnetic force is proportional to the intensity of the current, the intensity of the magnetic field of the solenoid may become stronger by increasing the intensity of the current. As described above, the electric field as shown in FIG. 5D may be formed by using currents whose direction is the same but intensities are different, at the pair of neighboring lower solenoids 130. In this case, the magnetic substance 140 disposed to have an S pole at the lower portion thereof may transmit an impact stimulation in a direction biased toward the N pole (along the arrow) with a stronger magnetic force between the pair of lower solenoids 130.

As described above, it can be found that not only the direction but also the intensity of the current flowing through the coil of each of the upper solenoid 110 and the lower solenoids 130 of the impact actuator 100 with 2-degree of freedom affects the generation position of the impact stimulation.

Figure 6:
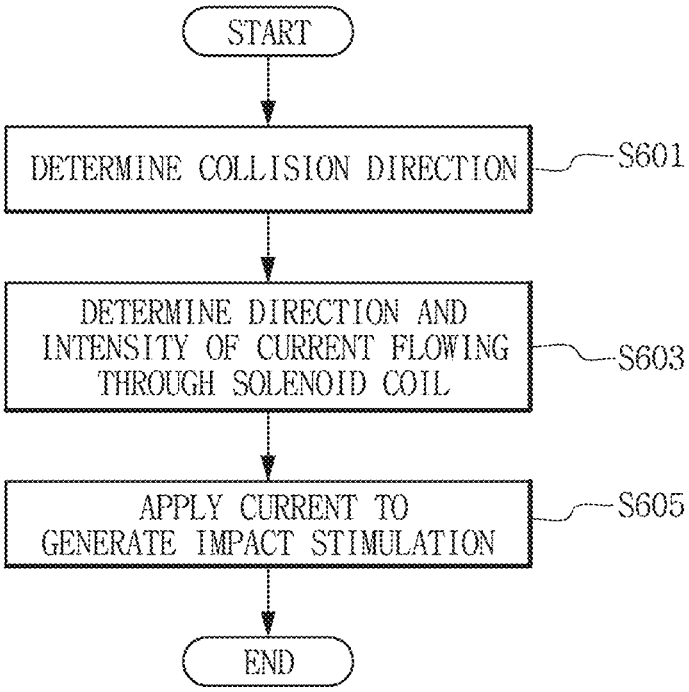
FIG. 6 is a flowchart for illustrating an impact controlling process using the impact actuator with 2-degree of freedom according to an embodiment of the present disclosure.

FIG. 6 is a flowchart for illustrating an impact controlling process using the impact actuator 100 with 2-degree of freedom according to an embodiment of the present disclosure. Referring to FIG. 6, a process of controlling the impact actuator 100 with the 2-degree of freedom includes determining a collision direction (S601), determining a direction and intensity of a current flowing through the solenoid coil (S603), and applying a current to generate an impact stimulation (S605).

First, if an impact stimulation is required, a stimulation generating direction may be calculated by the impact actuator 100 with 2-degree of freedom, and accordingly the collision direction of the magnetic substance 140 of the impact actuator 100 with 2-degree of freedom may be determined (S601). In addition, since the intensity and form of the stimulation may be variously modified, the collision strength (speed), the form of impact stimulation (for example, one-time stimulation or repeated vibration stimulation, vibration frequency) or the like may be determined along with the impact stimulation direction of the magnetic substance 140. At this time, since the stimulus is not yet generated, the magnetic substance 140 may be in a state of being fixed to the neutral position. For example, if a contact stimulation with a virtual object is generated to a user by using the impact actuator 100 with 2-degree of freedom in a virtual environment or game, the impact actuator 100 with 2-degree of freedom gives a stimulation according to a contact direction and a contact strength determined by the speed of the virtual object or the like, and the direction, strength, speed or frequency of the magnetic substance 140 of the impact actuator 100 with 2-degree of freedom magnetic substance 140 colliding with the body 120 may be determined. In addition, the impact actuator 100 with 2-degree of freedom having, for example, a cylindrical shape may be implemented in a form such as a joystick, and be utilized to generate haptic feedback for a user in a game. Also, the collision direction, strength, speed or frequency of the magnetic substance 140 of the impact actuator 100 with 2-degree of freedom may be determined according to interactions in the game.

Next, based on the determined direction and strength of the stimulation, the direction and intensity of the current flowing through the solenoid coil may be determined (S603). Based on the collision direction, strength, speed and the like of the magnetic substance 140 of the impact actuator 100 with 2-degree of freedom calculated by the direction and strength of the stimulation, it can be determined whether or not to supply a current respectively to the upper solenoid 110 and the plurality of lower solenoids 130 of the impact actuator 100 with 2-degree of freedom, and also the current direction and the current intensity may be determined. As shown in FIGS. 4 and 5, the moving direction and the collision strength of the magnetic substance 140 may be controlled by adjusting whether or not to supply a current respectively to the upper solenoid 110 and the plurality of lower solenoids 130, and adjusting the current direction and current intensity.

After that, a current is applied according to the direction and intensity of the current to be supplied to the solenoid coil determined in the former step to generate an impact stimulation (S605). As shown in FIGS. 4 and 5, the collision direction, strength, speed or frequency of the magnetic substance 140 may be controlled by adjusting whether or not to supply a current respectively to the upper solenoid 110 and the plurality of lower solenoids 130, and adjusting the current direction and current intensity. After the impact stimulation is generated, as shown in the third stage of FIG. 4, if the current does not flow to the upper solenoid 110 and the lower solenoids 130, or if the current direction is reversed so that an attractive force to the magnetic substance 140 is generated only at the upper solenoid 110, the magnetic substance 140 returns to the neutral position, which makes is possible to control so that the residual vibration is not left.

According to the present disclosure as described above, it is possible to provide an impact actuator with 2-degree of freedom, which may dynamically generate an impact stimulation by giving the impact stimulation in any direction on a two-dimensional plane and may regenerate an impact with a broad frequency band in the same direction, and the direction and strength of the impact may be appropriately controlled. In the specific embodiments described above, components included in the present disclosure have been expressed in the singular or plural form in accordance with the proposed specific embodiments. However, the singular or plural form is selected appropriately for the sake of convenience of description, and it should be understood that the embodiments described above are not limited to the singular or plural form. Even though any component is expressed in the plural form, the component may be provided singular. Also, even though any component is expressed in the singular form, the component may be provided in plural.

Meanwhile, even though the specific embodiments have been described above, various changes and modifications may be made thereto without departing from the technical scope of the present disclosure involved in the embodiments. Thus, the scope of the present disclosure should not be construed as limited to the embodiments described above, but should be determined by the scope of the appended claims and their equivalents.

REFERENCE SIGNS

| | |
|---|---|
| 100: impact actuator with 2-degree of freedom | 110: upper solenoid |
| 120: body | 130: lower solenoid |
| 140: magnetic substance | 301: upper plate |
| 303: lower plate | 305: solenoid core portion |

What is claimed is:

1. An impact actuator with 2-degree of freedom, comprising:

a body having a magnetic substance that is movable therein;

one upper solenoid attached to an upper portion of the body; and three or more lower solenoids attached to a lower portion of the body, wherein the upper solenoid and the three or more lower solenoids are independently supplied with AC power from a power supply, respectively.

2. The impact actuator according to claim 1, wherein the three or more lower solenoids are composed of the same four solenoids having a quartered cylindrical shape.

3. The impact actuator according to claim 1, wherein the magnetic substance is fixed to a neutral position that is a center portion of the body, when a current is not supplied to the upper solenoid and the three or more lower solenoids.

4. The impact actuator according to claim 3, wherein the magnetic substance is fixed by an attractive force with an iron member included at the neutral position of the body, the upper solenoid or the three or more lower solenoids.

5. The impact actuator according to claim 1, wherein the magnetic substance collides with the body by an impact of a direction and strength, which are determined by whether or not to supply a current to the upper solenoid and the three or more lower solenoids, respectively, and by at least one of a direction of the current and intensity of the current.

6. The impact actuator according to claim 5, wherein the magnetic substance returns to a neutral position after colliding with the body.

* * * * *